United States Patent [19]

Johnson

[11] 4,245,664

[45] Jan. 20, 1981

[54] CONTROLLED PRESSURE SEWER SYSTEM

[76] Inventor: Johnny T. Johnson, 272 Rushing Wind Rd., Irmo, S.C. 29063

[21] Appl. No.: 951,398

[22] Filed: Oct. 16, 1978

[51] Int. Cl.[3] ..... F17D 1/00

[52] U.S. Cl. ..... 137/236 R; 4/197

[58] Field of Search ..... 137/236 R, 205, 571; 4/1, DIG. 9, 321; 406/197

[56] References Cited

U.S. PATENT DOCUMENTS

| | | | |
|---|---|---|---|
| 154,728 | 9/1874 | Thompson | 137/566 |
| 2,791,471 | 5/1957 | Clancey | 406/197 |
| 4,155,851 | 5/1979 | Michael | 137/236 R |

*Primary Examiner*—Alan Cohan
*Attorney, Agent, or Firm*—L. Lawton Rogers, III

[57] ABSTRACT

The main trunk line of a sewer system is divided into serially connected sections and a predetermined hydrostatic head is established at the upstream end of each section. Sewage flow is restricted at the downstream end of each section, to maintain a pressure gradient along the flow path in each section. This maintains sewage flow in the trunk line despite the absence of an elevational gradient. Feeder lines are connected to the trunk line in relation to the pressure gradient such that back flow from the trunk line into the feeder lines is substantially inhibited without requiring check valves.

13 Claims, 3 Drawing Figures

Fig. 2
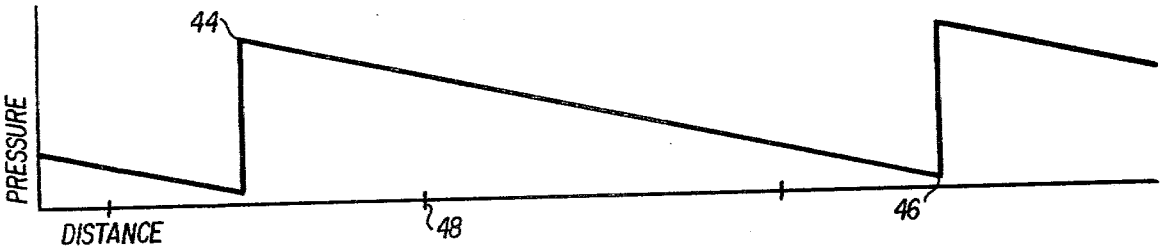
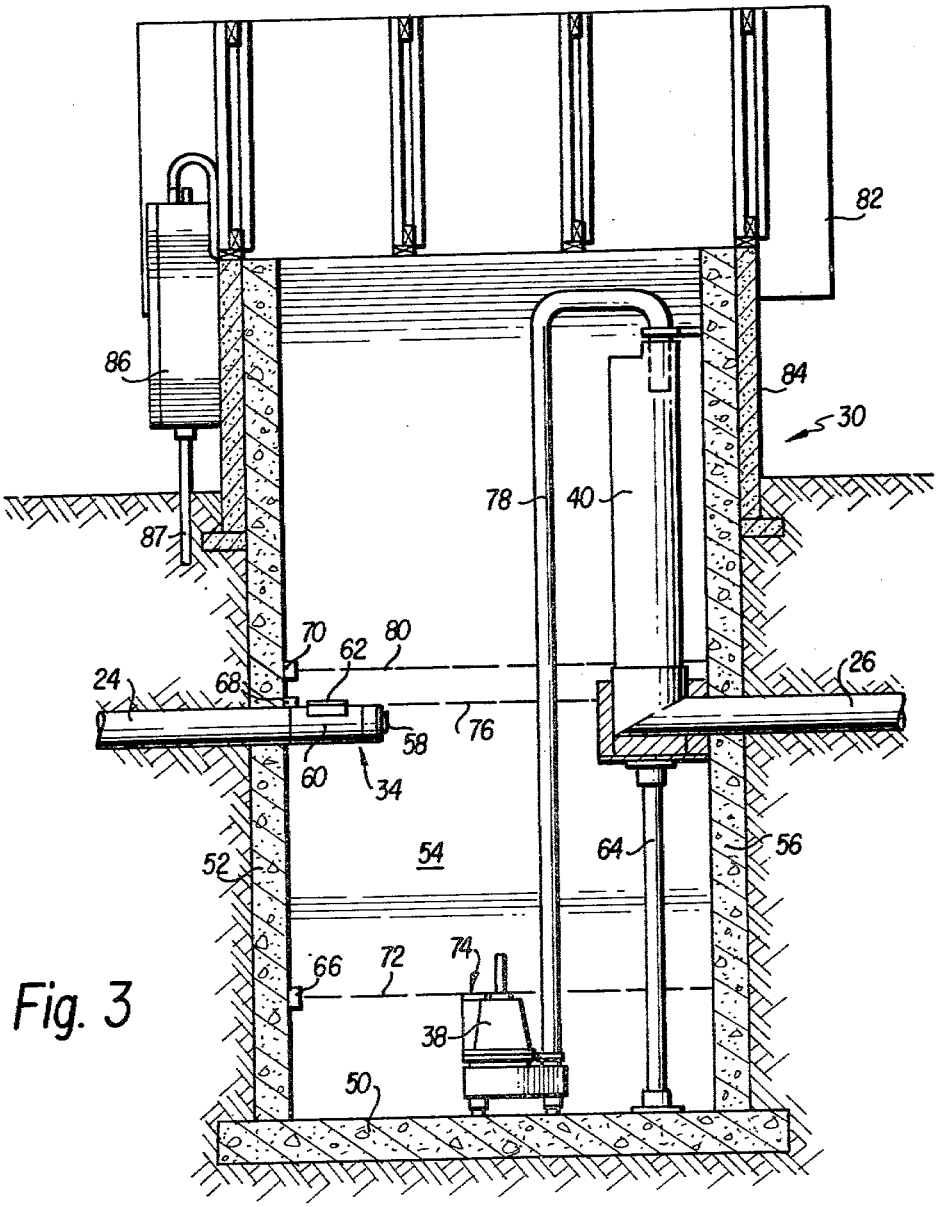
Fig. 3

CONTROLLED PRESSURE SEWER SYSTEM

BACKGROUND OF THE INVENTION

The present invention relates to a sewer system in which sewage is conveyed along a main trunk line from a plurality of sewage sources to a destination point, and more particularly, to a sewage system having a generally horizontal trunk line in which the flow of sewage along the trunk line is maintained despite the absence of an elevation gradient along the path of sewage flow and in which the back flow of sewage from the trunk line to the sources is substantially inhibited without requiring check valves to be placed in the path of sewage flow.

In the past, systems for conveying sewage have generally required an elevation gradient to be present along the path of sewage flow in order for the flow of sewage to be maintained. This can be easily accomplished where the terrain of the land in which the sewer system is located slopes downwardly toward a predetermined destination point where the sewage is disposed of, processed, or the like. However, where the terrain is substantially horizontal or slopes slightly upwardly, conventional gravity systems can not maintain sewage flow.

In one known prior art type of sewer system, such as illustrated in U.S. Pat. No. 2,012,495, the sewer pipe line is constructed with an elevation gradient despite the absence of such a gradient in the terrain of the land in which the sewer system is located. This is accomplished by successively placing the sewer line at greater depths underground along the flow path of the sewage, to provide a downhill flow path. This construction can only be used for sewer systems of relatively short lengths, since the costs of digging and laying the sewer line will become prohibitive as the length of the sewer line increases, due to the requirement of going deeper into the ground.

Other prior art attempts at solving this problem are illustrated in U.S. Pat. Nos. 3,211,167 issued to Clift et al, and 3,730,884, issued to Burns et al. In the Clift patent a pump is provided at each source of sewage, e.g. dwelling, to pump sewage from the dwelling into a main pipe line and thereby induce sewage flow in the pipe line. The costs of providing a pump in each dwelling and maintaining such a large number of pumps greatly reduces the feasibility of such a system. In the system of the Burns patent, a subatmospheric pressure is provided at the downstream end of each of a plurality of sewer pipe lines. The cost of producing a vacuum in a plurality of pipe lines and the vulnerability of such a system to malfunction, due to cracks in a pipe or the like, may render such a vacuum system impractical.

Another problem quite common to sewage systems is that of back flow of sewage. When a sewage flow path becomes clogged, the sewage has a tendency to flow in a reverse direction towards the sewage sources located immediately upstream of the clogged point, due to the flow of sewage from sources further upstream. Therefore, it becomes necessary to provide check valves at various points along the main pipe line of the sewer system as well as within the various feeder lines leading from the sewage sources to the main pipe line. Due to the nature of the materials flowing in the sewer system, the check valves themselves can quite easily become clogged, and therefore it is necessary to provide manholes or other means of access to the various check valves, further increasing the cost of the sewer system both in terms of initial construction and maintainance.

OBJECTS OF THE INVENTION

Therefore, it is an object of the present invention to provide a novel method and system for conveying sewage in which sewage flow through a main trunk line is maintained despite the absence of an elevation gradient in the terrain of the land in which the system is located.

It is another object of the invention to provide a novel method and system for conveying sewage in which the need for providing an elevation gradient in the sewage flow path is eliminated.

It is a further object of the present invention to provide a novel method and system for conveying sewage in which the pressure in a sewer line is controlled to induce a sewage flow which conforms to the requirements of regulations relating to such.

It is yet another object of the present invention to provide a novel method and system for conveying sewage in which the back flow of sewage towards a sewage source is substantially inhibited without the need for providing check valves or the like in the path of sewage flow.

BRIEF DESCRIPTION OF THE DRAWINGS

FIG. 2 is a graph of pressure versus distance illustrating the pressure in the main trunk line of the sewer system illustrated in FIG. 1; and FIG. 3 is a side view in elevation of the details of a pump station for a sewer system constructed in accordance with the present invention.

DESCRIPTION

Figure 1:
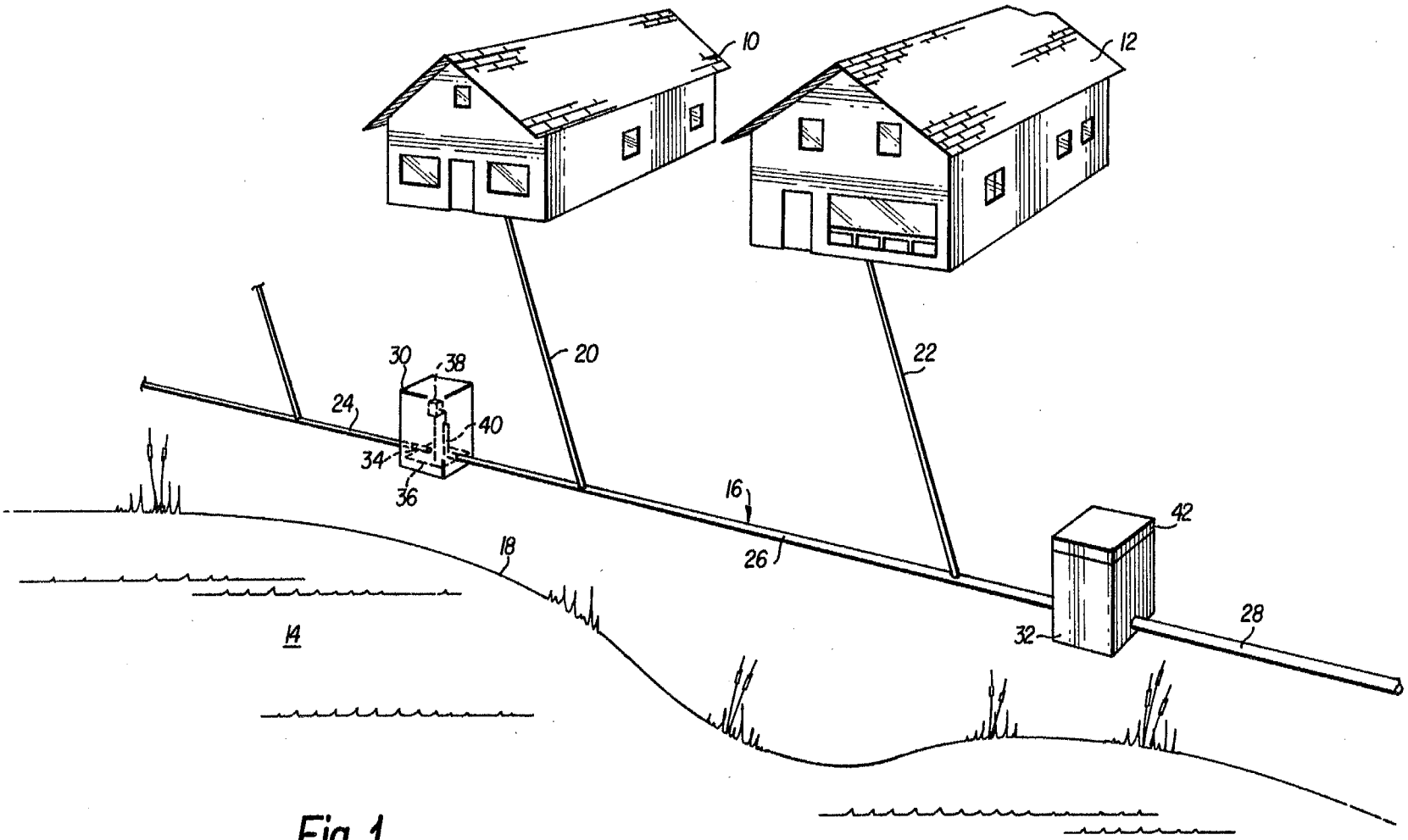
FIG. 1 is a view in perspective illustrating a portion of a sewage system constructed in accordance with the present invention.

In its preferred embodiment, the present invention is directed towards maintaining the flow of sewage conveyed by means of a trunk line situated on substantially horizontal terrain, from a source of sewage, such as a dwelling, to a predetermined destination point where the sewage is disposed of, processed, or the like. For example, as illustrated in FIG. 1, a sewer system constructed in accordance with the present invention is suitable for conveying sewage from a plurality of houses 10, 12, located around a lake 14, by means of a main trunk line 16 located near the shore line 18 of the lake and lying in a substantially horizontal plane. The sewage is fed from the individual houses 10, 12 to the trunk line 16 by means of feeder lines 20, 22. In a conventional sewer system, sewage will be fed from the individual sewage sources within a house, e.g., bathroom, kitchen, laundry room, etc., to a septic tank (not shown) and thence from the septic tank to the trunk line 16 by means of the feeder lines 20, 22.

In accordance with the present invention, the trunk line 16 is divided into a plurality of serially connected sections 24, 26, 28. A pumping station 30, 32 including a wet well connects adjacent trunk line sections, and maintains a controlled pressure gradient in each of the sections 24, 26, 28.

As illustrated in dotted lines in FIG. 1, the downstream end of a trunk line section 24 includes a suitable flow restricting means 34, such as an elbow or inverted U-tube. The sewage flowing in the trunk line section 24 is received in a wet well 36 formed by the walls of the pumping station 30. The sewage present in the wet well 36 is pumped into the upstream end of the immediately following trunk line section 26 by means of a pump 38.

The upstream end of a trunk line section 26 has a container 40 attached thereto. The lower end of the container 40 is in fluid communication with the upstream end of the trunk line section 26, and the container has a sufficient vertical height such that when the container 40 is filled with sewage, a hydrostatic head is provided which establishes a predetermined fluid pressure at the upstream end of the pipe line section 26.

Preferably, the trunk line 16 and the pumping stations 30, 32 are located underground, with only a small portion 42 of each pumping station being located above ground to provide access thereto.

In the operation of a sewer system constructed in accordance with the present invention, the flow restricting means 34 at the downstream end of each section serves to maintain each section full of sewage. Preferably, the pump 38 in each pumping station 30, 32 pumps sewage into the upper end of the container 40 at a rate which is greater than the rate of flow of the sewage through the trunk line 16. Sewage which spills over from the upper end of the container 40 is received in the wet well 36 and thereafter again pumped up to the upper end of the container 40.

The material which is used to construct the trunk line 16 has a known friction factor which reduces the pressure of the sewage in the trunk line 16 as it flows therethrough. Due to the presence of the friction factor and the fact that the trunk line 16 is maintained full of sewage, a predetermined pressure gradient is maintained along each section 24, 26, 28 of the trunk line 16.

The value of the pressure in the trunk line 16 with respect to distance along the flow path of the sewage is illustrated in FIG. 2. It can be seen that the upstream end of each section has a pressure 44 which is equal in value to the hydrostatic head created by the container 40 when filled with sewage. Due to the friction factor of the trunk line 16, the pressure in the trunk line section decreases substantially linearly with respect to distance along the section. The length of each trunk line section 24, 26, 28 is preferably established with respect to the friction factor of the trunk line material such that a relatively small pressure 46, such as that equal to a hydrostatic head of one or two inches, is present at the downstream end of the section.

In a preferred embodiment of the present invention, the trunk line 16 is constructed of PVC pipe having a 6 inch diameter. Such pipe has a friction factor of 0.2 feet reduction in pressure for every 100 feet of pipe line. A hydrostatic head of 4 feet is provided at the upstream end of each section, and this produces a sewage flow rate of 2 feet per sec., or 175 gallons per minute, which is sufficient to meet the Code requirements relating to the minimum rate of flow of sewage through a sewer system. Knowing the value of the hydrostatic head at the upstream end of each section and the friction factor of the trunk line material, one is able to compute the length of each section. In the disclosed preferred embodiment, each trunk line section 24, 26, 28 is 2000 feet long.

Due to the presence of the controlled pressure at the upstream end of each section, it will be readily apparent that the value of the pressure at any particular point in the trunk line 16 will not rise above that depicted in the graph of FIG. 2. Since the maximum pressure in the trunk line 16 is fixed by the height of the container 40, the present invention makes it possible to connect the feeder lines 20, 22 to the trunk line 16 and provide sewage flow from the sources 10, 12 to the trunk line 16 without the need for check valves to prevent back flow of sewage from the trunk line 16 into the feeder lines 20, 22.

To determine the point at which a feeder line is to be connected to the trunk line 16, it is only necessary to establish the vertical elevation of the sewage source 10, 12 above the trunk line 16. Once this has been established, the feeder line from that particular sewage source can be connected at any point along the trunk line 16 at which the maximum value of the pressure in the trunk line is less than the equivalent hydrostatic head created by the sewage source in the feeder line.

For example, if a sewage source 10 is located at an elevation of three feet above the trunk line 16, the feeder line 20 from that sewage source can be connected to any point on the trunk line 16 downstream of the point 48 at which the pressure in the pipe line section 26 is equivalent to a 3 foot hydrostatic head. Since the pressure at the downstream end of the feeder line 20 is equal to that produced by a 3 foot hydrostatic head, and further since the pressure in the trunk line 16 at the point of connection will always be less than this pressure in the feeder line, it can be seen that the back flow of sewage from the trunk line 16 into the feeder line 20 is substantially inhibited without the need for providing check valves in the feeder line or the trunk line. Therefore, the cost of a sewer system constructed in accordance with the present invention is substantially reduced over that of prior art systems.

The elements comprising a pumping station 30 are illustrated in greater detail in FIG. 3. The pumping station 30 comprises a wet well formed by a base 50 and a plurality of vertical walls 52, 54, 56. The wet well is preferably constructed of a size which will provide sufficient capacity for sewage flowing in the trunk line 16 at peak times.

The downstream end of a trunk line section 24 protrudes through one of the vertical walls 52 and is in fluid communication with the wet well. A flow restricting means 34 is provided at the end of the pipe line section 24 by a plug 58 which is fitted onto the pipe line. Sewage flowing in the trunk line section 24 flows into the wet well by means of an opening 62 created by a "Tee" joint which has the vertical leg thereof cut off flush with the remaining portion of the joint. The plug 58 maintains the trunk line section 24 full of sewage and the opening 62 at the top of the Tee joint allows the wet well to receive the sewage flowing in the trunk line section.

The upstream end of the immediately following trunk line 26 is in fluid communication with the lower end of the container 40. In a preferred embodiment, the container 40 is constructed of PVC pipe having a 12 inch diameter. The container 40 has a 4 foot height to establish the necessary predetermined hydrostatic head. The upper end of the container 40 is open to receive sewage pumped by the pump 38 and to allow any excess sewage to spill over into the wet well, as described previously. The container 40 is supported within the wet well by means of a suitable standard 64.

The pump 38 within the pumping station 30 is controlled to be actuated and deactuated in accordance with the level of sewage within the wet well by means of sensors 66, 68, 70 located within the wet well. The sensor 66 provides an indication when the sewage has reached a level 72 equal to the height of the intake port 74 of the pump 38. When the sensor 66 provides such an indication, a suitable control means turns the pump 38 off to prevent damage and overheating of the pump 38. After the pump 38 has been turned off, the level of sewage in the wet well will rise until a second sensor 68 provides an indication that the sewage has reached a level 76 which is substantially the same height as the output port 62 at the downstream end of the trunk line section 24. When the sensor 68 provides an indication that this level has been reached, the control means actuates the pump to begin pumping sewage through the conduit 78 and into the upper end of the container 40.

If the level of sewage should continue to rise after the pump 38 has been actuated and reach a level 80 which is higher than the output port 62 of the trunk line section 24, a third sensor 70 will provide and indication of such a condition. When such an indication is provided, the control means can actuate a second auxiliary pump (not shown) to pump sewage from the wet well into the container 40 at a greater rate. In addition, an alarm or other such indicator can be actuated to provide a signal indicating that sewage is not flowing properly in the trunk line section 26 or that some other malfunction exists.

In a preferred embodiment, the sensors 66, 68, 70 can be mercury float level controls which are suspended from an upper portion of a wall and maintained at their respective levels 72, 76, 80 by means of cables of suitable lengths. The pump 38 can be a 1½ H.P., 240 volt, single phase pump.

The wet well 30 can include a roof 82 and a brick exterior 84, or the like, for the portion thereof which extends above ground, to provide a measure of aesthetic appeal.

A control box 86 can be located on the exterior of the pumping station 30 and anchored in the ground by means of a suitable support 87. The control box can include automatic control circuitry for controlling the actuation and deactuation of the pump 38 in accordance with signals from the sensors 66, 68, 70, as described previously. In addition, the control box can include other control elements which allow individual operations within the pumping station 30 to be manually controlled. For example, the rate at which the pump 38 pumps sewage into the container 40 may be adjustable. In addition, valves for controlling the flow of sewage from the trunk line section 24 or from the container 40 into the trunk line section 26 may be controlled from the control box 86. Furthermore, valves can be positioned along the container 40 at different vertical intervals and controlled from the control box 86 to provide an adjustable hydrostatic head which is maintained by the container 40.

ADVANTAGES AND SCOPE OF THE INVENTION

From the foregoing, it can be seen that the present invention provides a sewer system wherein the pressure within the main trunk line of the system is controlled in a manner which allows sewage to be conveyed along the trunk line despite the absence of an elevation gradient within the trunk line. In addition, a predetermined pressure gradient is established and maintained within each section of the trunk line and allows feeder lines to be connected to the trunk line in such a manner that backflow of sewage from the trunk line into the feeder lines is substantially inhibited without the need for providing check valves in the sewer system. The cost of a sewer system constructed in accordance with the present invention is substantially reduced over those of prior art systems since the present invention requires considerably less elements and materials than those of the prior art.

Other embodiments and applications of the present invention within the spirit and essential characteristics thereof and different from that previously described will be apparent to those of ordinary skill in the art. For example, while the invention has been disclosed in connection with a sewer system in which the trunk line is generally horizontal, it will be apparent that the invention can also be used in sewer systems where the terrain of the land causes the trunk line to have a slight uphill or downhill grade. In such a case, the slope of the pressure line illustrated in FIG. 2 will be varied, and it will only be necessary to change the distance between pumping stations and the location of the connection point of the feeder lines to the trunk line.

The presently disclosed embodiment is therefore to be considered in all respects as illustrative and not restrictive. The scope of the invention is indicated by the appended claims rather than by the foregoing description, and all changes which come within the meaning and range of equivalency of the claims are therefore intended to be embraced therein.

What is claimed is:

1. In a sewer system having a generally horizontal trunk line and a plurality of feeder lines connected thereto for conveying sewage from sources at different elevations above the elevation of the trunk line, the method of conveying sewage from the plurality of sources into the trunk line without the need for check valves to inhibit back flow from the trunk line into the feeder lines, and for conveying sewage through the trunk line despite the absence of an elevation gradient along the trunk line in the direction of desired sewage flow, comprising the steps of:

(a) dividing the trunk line into a plurality of serially connected sections;

(b) establishing a predetermined pressure at the upstream end of each of the plurality of sections and restricting sewage flow at the downstream end of each of the plurality of sections to thereby provide a decreasing pressure gradient along the length of each of the plurality of sections in the direction of desired sewage flow despite the absence of an elevation gradient in the direction of desired sewage flow; and, (c) connecting each of the feeder lines into the trunk line at a point where the pressure at the downstream end of the feeder line as a result of the elevation of the source above the trunk line is greater than the pressure at that point in the trunk line to thereby eliminate the need for a check valve to prevent back flow from the trunk line into the feeder line.

2. The method of claim 1 wherein the step of establishing a predetermined pressure at the upstream end of each of the plurality of sections of the trunk line includes the steps of:

(a) providing a container for each section in fluid communication at its lower end with the upstream end of the section of the trunk line, the container having sufficient vertical height to establish a hydrostatic head equal to the desired predetermined pressure at the upstream end of the section; and, (b) pumping sewage from the downstream end of the immediately preceding section of the trunk line into the upper end of the container.

3. The method of claim 2 wherein the step of pumping sewage includes pumping the sewage into the container at a rate greater than the rate of flow of the sewage through the trunk line to maintain the container and the trunk line full of sewage.

4. A sewer system in which the flow of sewage towards a destination point is maintained despite the absence of an elevation gradient along the path of sewage flow, and in which the back flow of sewage towards a source is substantially inhibited without the need for check valves, said system comprising:

a generally horizontal trunk line divided into a plurality of serially connected sections;

means for establishing a predetermined pressure at the upstream end of each section;

means for restricting sewage flow at the downstream end of each section to thereby establish a decreasing pressure gradient along the length of each section in the direction of sewage flow despite the absence of an elevation gradient along the trunk line; and, at least one feeder line for supplying sewage to said trunk line from a sewage source located at an elevation above the trunk line, said feeder line being connected to the trunk line at a point where the pressure in the trunk line is less than the pressure at the downstream end of the feeder line resulting from the elevation of the source, to thereby eliminate the need for a check valve to inhibit back flow of sewage from the trunk line to the source.

5. The system of claim 4 wherein said pressure establishing means includes:

a container in fluid communication at its lower end with the upstream end of a section of the trunk line, said container having a sufficient vertical height to establish a hydrostatic head equal to said predetermined pressure; and, means for conveying sewage from the downstream end of the immediately preceding trunk line section into the upper end of said container to provide the hydrostatic head and thereby establish said predetermined pressure.

6. The system of claim 5 wherein said sewage conveying means includes a well for receiving sewage from the downstream end of the immediately preceding section and a pump for pumping the received sewage from the well into the upper end of the container.

7. The system of claim 6 wherein said pump pumps sewage into the container at a rate greater than the rate of flow of sewage through said trunk line to thereby maintain said container and said trunk line full of sewage.

8. A method of conveying sewage effluent along a pipe line without requiring an elevation gradient to be present along the flow path of the effluent in the direction of desired flow, comprising the steps of:

dividing the pipeline into a plurality of serially connected lateral sections; and, establishing a predetermined pressure gradient in each of the lateral sections in the direction of desired flow independently of an elevation gradient in the lateral section in the direction of desired flow by means of an upright section at the upstream end of each lateral in which the effluent at the upstream end of each of the upright sections is maintained at a predetermined level above the downstream end of each of the lateral sections of pipeline to thereby provide a hydrostatic head at the upstream end of each of the sections.

9. A method of conveying sewage effluent along a pipe line without requiring an elevation gradient to be present along the flow path of the effluent in the direction of desired flow, comprising the steps of:

dividing the pipeline into a plurality of serially connected lateral sections;

establishing a predetermined pressure gradient in each of the lateral sections in the direction of desired flow independently of an elevation gradient in the lateral section in the direction of desired flow; and connecting a source of effluent located at an elevation above the pipeline to a point on the pipeline by means of a conduit, wherein the pressure in the pipeline at the point of connection is less than the pressure at the downstream end of the conduit caused by the elevation of the source, to inhibit back flow of the effluent from the pipe line to the source without the need for check valves.

10. A sewage system in which sewage is conveyed to a destination point despite the absence of an elevation gradient along the path of sewage flow in the direction of sewage flow, comprising:

a trunk line divided into a plurality of serially connected sections each having an open upright portion at the upstream end hereof;

means for establishing a predetermined positive pressure at the upstream end of each section including a pump for feeding sewage from the downstream end of each section into the open upright portion at the upstream end of the immediately following section of the trunk line to thereby maintain at the upstream end of each section the sewage at a predetermined level above the downstream end of each section to thereby produce a hydrostatic head at the upstream end of each open section which is equal to said predetermined pressure; and, means for restricting sewage flow at the downstream end of each section to maintain a predetermined pressure gradient in each section which decreases along the path of travel of the sewage in each section in the direction of sewage flow and thereby induces sewage flow despite the absence of an elevation gradient along the trunk line in the direction of sewage flow.

11. The system of claim 10 further including at least one feeder line for supplying sewage to said trunk line from a sewage source located at a height above the trunk line, said feeder line being connected to a point on the trunk line at which the pressure in the trunk line is less than the pressure at the downstream end of the feeder line resulting from the elevation of the sewage source above the trunk line, to inhibit back flow of sewage from the trunk line to the feeder line without the need for check valves.

12. A sewer system for conveying sewage through a generally horizontal trunk line despite the absence of an elevation gradient along the flow path of the sewage, and for conveying sewage from a plurality of sources located at different elevations above the trunk line into the trunk line without the need for check valves to inhibit the back flow of sewage from the trunk line toward the sources, said system comprising:

a generally horizontal trunk line divided into a plurality of serially connected sections;

a plurality of containers having respective upper and lower ends, one container being provided for each of the sections of said trunk line, each of said containers having a sufficient vertical height to establish a predetermined hydrostatic head at the lower end thereof when filled with sewage, the lower end of each container being connected to the upstream end of an associated trunk line section and in fluid communication therewith to provide a predetermined pressure at the upstream end of each trunk line section which is equal to said hydrostatic head;

a well in fluid communication with the downstream end of each of said sections for receiving the sewage flowing in the associated section;

means for pumping sewage from the well associated with a first trunk line section into the upper end of the container associated with the upstream end of the next following trunk line section, said pumping means being actuable to pump sewage into said container at a rate greater than the rate at which sewage flows through the trunk line to maintain said container full of sewage and thereby provide said hydrostatic head, the upper end of said container being in fluid communication with the well associated with said first section to enable said well to receive any spillover from the container caused by the pumping rate of said pumping means;

means for controlling said pumping means to actuate said pumping means when the sewage in said well reaches a first level and to deactivate the pumping means when the sewage in the well reaches a second level lower than said first level;

means for restricting flow located at the downstream end of each of said trunk line sections to maintain each of said sections full of sewage and thereby provide a pressure gradient in each section which decreases along the path of flow of the sewage to induce the flow of sewage in each trunk line section despite the absence of an elevation gradient along the flow path of the sewage; and, a plurality of feeder lines for conveying sewage from a plurality of sewage sources located at different elevations above the trunk line into the trunk line, said feeder lines being respectively connected in fluid communication with said trunk line at a point on the trunk line where the pressure in the trunk line is less than the pressure at the downstream end of the feeder line resulting from the elevation of an associated source above the trunk line, to thereby inhibit the back flow of sewage from the trunk line into the feeder lines without the need for check valves.

13. The method of claim 8 including the step of pumping the effluent from the downstream end of each of the lateral sections into the top of the upright section of the immediately downstream section of pipeline.

* * * * *